US011381898B2

(12) United States Patent
Choi et al.

(10) Patent No.: US 11,381,898 B2
(45) Date of Patent: Jul. 5, 2022

(54) CANAL-TYPE EARPHONE HAVING PRESSURE EQUILIBRIUM STRUCTURE

(71) Applicant: EM-TECH Co., Ltd., Gyeongsangnam-do (KR)

(72) Inventors: Cheon Kyu Choi, Gyeonggi-do (KR); You Lim Choi, Gyeonggi-do (KR)

(73) Assignee: EM-TECH CO., LTD., Gyeongsangnam-Do (KR)

( * ) Notice: Subject to any disclaimer, the term of this patent is extended or adjusted under 35 U.S.C. 154(b) by 0 days.

(21) Appl. No.: 17/176,311

(22) Filed: Feb. 16, 2021

(65) Prior Publication Data

US 2021/0258677 A1 Aug. 19, 2021

(30) Foreign Application Priority Data

Feb. 17, 2020 (KR) ..... 10-2020-0018884

(51) Int. Cl.
*H04R 1/10* (2006.01)
*H04R 9/02* (2006.01)
*H04R 9/06* (2006.01)

(52) U.S. Cl.
CPC ..... *H04R 1/1016* (2013.01); *H04R 1/1075* (2013.01); *H04R 9/025* (2013.01); *H04R 9/06* (2013.01); *H04R 2400/11* (2013.01); *H04R 2460/11* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,738,487 | B1 * | 5/2004 | Nageno | H04R 1/1016 381/322 |
| 8,270,657 | B2 * | 9/2012 | Takigawa | H04R 1/1041 381/380 |
| 8,670,586 | B1 * | 3/2014 | Boyle | H04R 1/1091 381/370 |
| 9,237,394 | B2 | 1/2016 | Seo et al. | |
| 2007/0189570 | A1 * | 8/2007 | Matsuo | H04R 1/345 381/382 |
| 2018/0020281 | A1 * | 1/2018 | Wurtz | G10K 11/17881 |
| 2020/0029147 | A1 * | 1/2020 | Chou | H04R 1/1058 |

FOREIGN PATENT DOCUMENTS

| | | | | |
|---|---|---|---|---|
| CN | 102648639 | A * | 8/2012 | H04R 1/1016 |
| JP | 2010157814 | A | 7/2010 | |
| KR | 20060034000 | A | 4/2006 | |

(Continued)

*Primary Examiner* — Angelica M McKinney
(74) *Attorney, Agent, or Firm* — Murphy, Bilak & Homiller, PLLC

(57) ABSTRACT

Disclosed is a canal-type earphone having a pressure equilibrium structure. The canal-type earphone includes: a microspeaker including a frame, a magnetic circuit, a voice coil, and a diaphragm; an earphone housing including an accommodation space accommodating the microspeaker and a nozzle extending to one side of the accommodation space; a vent hole formed at the earphone housing, installed in at least one of portions located in front of the microspeaker in the nozzle and the accommodation space, and allowing air to flow outside and inside the earphone housing; and an eartip coupled to outside of the nozzle of the earphone housing.

15 Claims, 11 Drawing Sheets

(56) References Cited

FOREIGN PATENT DOCUMENTS

| | | | | |
|---|---|---|---|---|
| KR | 100703122 | B1 | | 4/2007 |
| KR | 101423570 | B1 | * | 7/2014 |
| KR | 101446611 | B1 | * | 10/2014 |
| KR | 101446611 | B1 | | 10/2014 |
| KR | 101558091 | B1 | | 10/2015 |

* cited by examiner

CANAL-TYPE EARPHONE HAVING PRESSURE EQUILIBRIUM STRUCTURE

TECHNICAL FIELD

The present disclosure relates to a canal earphone having a pressure equilibrium structure.

BACKGROUND

Earphones are divided into closed air type earphones in which the rest of the earphones is blocked except for sound radiating holes inserted into the ear canal and open-air type earphones including tuning holes and ducts in addition to sound radiating holes.

The closed air type earphone transmits sound of a receiver installed in the earphone directly into the user's ear, allowing for listening to sound even with small power, and in particular, a canal-type earphone inserted into the user's ear through an earpiece has excellent sound insulation to block external noise.

However, in the case of the canal-type earphone, as the ear canal is completely sealed, a difference in atmospheric pressure between the inside and outside of the ear canal occurs, and the ears may be deafened or some people may feel uncomfortable. Korean Patent Registration No. 10-1558091 discloses a canal-type earphone including a pressure equilibrium means to improve such a pressure difference.

FIG. 1 is a view showing a canal-type earphone including a pressure equilibrium means according to the related art. A canal-type earphone 1, as the related art canal-type earphone, includes a speaker unit 10, a housing 20 accommodating the speaker unit 10, and an earpiece 23 installed on an outer surface of a tube 25 integrally formed at a front of the housing 20. The speaker unit 10 installed in the housing 20 includes a cylindrical frame 11, a magnetic circuit 12 installed in the frame 11, and a diaphragm 13 vibrating vertically by a magnetic force of the magnetic circuit 12. The frame 11 has a cylindrical shape, and a cover 18 is installed at the front of the frame 11 and a bracket 19 is installed at the rear of the frame 11. A through hole 18*a* is formed at the center of the cover 18 to emit sound generated from the diaphragm 13 forward. Also, a through hole 19*a* is formed at the center of the bracket 19 to emit sound generated from the diaphragm 13 backward. Also, a through hole 16*a* is formed at the center of a yoke 16 to emit sound generated from the diaphragm 13 backward.

A gasket 30 is installed on a front surface of the cover 18. The gasket 30 is formed of an elastic material such as rubber or silicone. In addition, a through hole 30*a* is formed at the center of the gasket 30 to emit sound radiated from the speaker unit 10.

A pressure equilibrium means for discharging air in front of the speaker unit 10 to the rear of the speaker unit 10 to eliminate a difference in air pressure between the user's ear canal and external air is provided. The pressure equilibrium means provided in the earphone according to the related art includes a side air passage 50 for discharging air inside A the tube 25 or air inside B the speaker unit 10 to a side C of the gasket 30 or to a side D of the speaker unit 10 and a rear air passage 60 for discharging air on the side C of the gasket 30 or air on the side D of the speaker unit 10 to a rear E of the speaker unit 10.

However, in the case of the canal-type earphone, if the ear canal is not completely sealed when the earphone is worn, a sound pressure inevitably decreases at a low frequency range. Therefore, there is a need to develop a structure capable of improving deafening of the canal-type earphone by providing an air passage.

SUMMARY

An aspect of the present disclosure provides a canal-type earphone having a pressure equilibrium structure capable of opening and closing a vent hole for improving a pressure difference as necessary, while improving a pressure difference between an ear canal and the outside when worn on.

According to an aspect of the present disclosure, there is provided a canal-type earphone having a pressure equilibrium structure, comprising: a microspeaker including a frame, a magnetic circuit, a voice coil, and a diaphragm; an earphone housing including an accommodation space accommodating the microspeaker and a nozzle extending to one side of the accommodation space; a vent hole formed at the earphone housing, installed in at least one of portions located in front of the microspeaker in the nozzle and the accommodation space, and allowing air to flow outside and inside the earphone housing; and an eartip coupled to outside of the nozzle of the earphone housing.

In addition, as another example of the present disclosure, there is provided a canal-type earphone having a pressure equilibrium structure including a mesh covering the vent hole.

In addition, as another example of the present disclosure, there is provided a canal-type earphone having a pressure equilibrium structure further including a switch bracket rotatably coupled to the earphone housing, adjusting an opening degree of the vent hole and closing the vent hole.

In addition, as another example of the present disclosure, there is provided a canal-type earphone having a pressure equilibrium structure, in which at least one vent hole may be provided on the nozzle, the nozzle may include a recess communicating with the vent hole, having a gap with an inner surface of the eartip, and provided on an outer surface of the nozzle, further including a vent path defined by the inner surface of the eartip and the recess of the nozzle and communicating with the vent hole, wherein the switch bracket may open and close the vent path.

In addition, as another example of the present disclosure, there is provided a canal-type earphone having a pressure equilibrium structure, in which a sealing member may be provided between the switch bracket and the earphone housing.

In addition, as another example of the present disclosure, there is provided a canal-type earphone having a pressure equilibrium structure, in which the vent hole includes at least one vent hole formed in the one portion located in front of the microspeaker in the accommodation space, and the earphone housing has a conduit provided on an inner surface thereof and communicating with the vent hole.

In addition, as another example of the present disclosure, there is provided a canal-type earphone having a pressure equilibrium structure, in which the conduit may be formed by a rib protruding from an inner surface of the earphone housing.

In addition, as another example of the present disclosure, there is provided a canal-type earphone having a pressure equilibrium structure, the conduit may be formed by a rib protruding from an inner surface of the earphone housing and a counterpart attached to the rib.

In addition, as another example of the present disclosure, there is provided a canal-type earphone having a pressure equilibrium structure, in which the counterpart may be any one of a cover, a tape, a film, and a sheet covering the diaphragm of the microspeaker.

In addition, as another example of the present disclosure, there is provided a canal-type earphone having a pressure equilibrium structure, further including: a sound guide bracket coupled to the front side of the microspeaker and having a guide tube extending into the nozzle.

In addition, as another example of the present disclosure, there is provided a canal-type earphone having a pressure equilibrium structure, in which the vent hole may include at least one vent hole formed at a portion located in front of the microspeaker in the accommodation space, and a surface on which the vent hole is formed in the accommodation space and the bracket may be spaced apart from each other.

In addition, as another example of the present disclosure, there is provided a canal-type earphone having a pressure equilibrium structure, in which the conduit may be formed by a rib protruding from the inner surface of the earphone housing to the bracket.

The receiver unit provided by the present disclosure may have a vent hole formed at the earphone housing to achieve pressure equilibrium inside and outside the ear canal.

Generally, when the vent hole is closed, a sound pressure level (SPL) is high at a low frequency region, and when the vent hole is opened to relieve deafening of the ear, loss of SPL occurs at the low frequency region. Therefore, the user may adjust a use aspect of the earphone by selectively opening the vent hole using the switch bracket to resolve deafening of the ear or improving a sound pressure of the low frequency range.

Those skilled in the art will recognize additional features and advantages upon reading the following detailed description, and upon viewing the accompanying drawings.

DETAILED DESCRIPTION

Hereinafter, the present disclosure will be described in detail with reference to the accompanying drawings.

Figure 1:
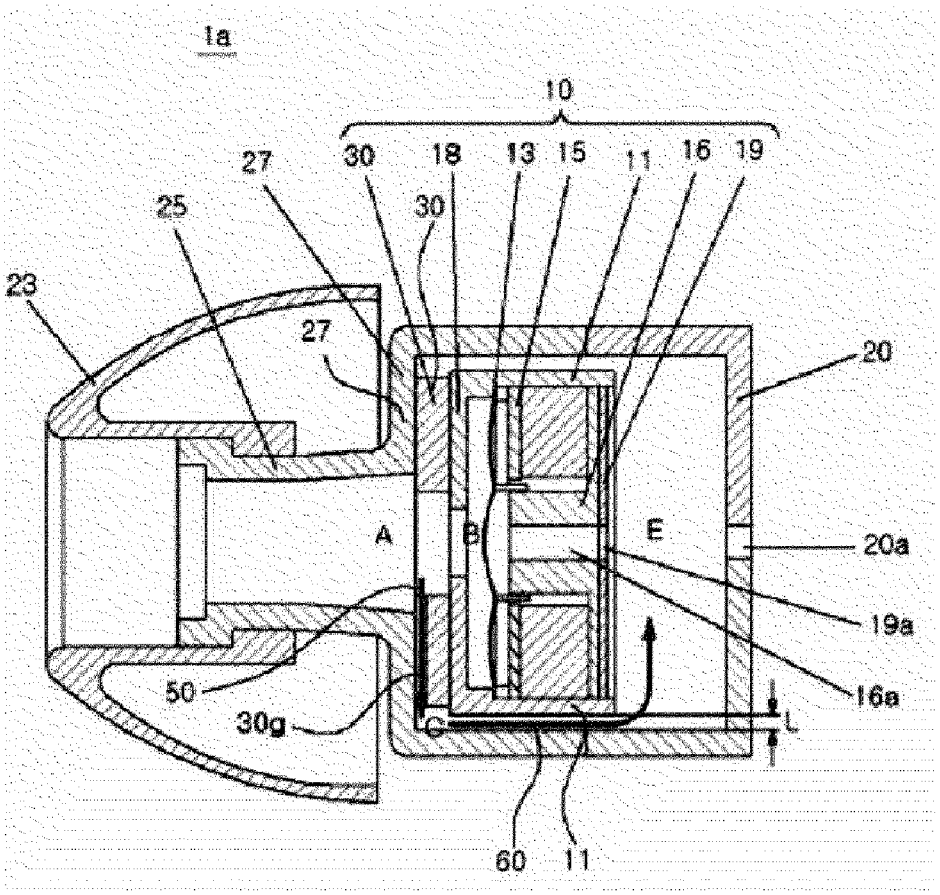
FIGURE 1 (PRIOR ART)
FIG. 1 is a view showing a canal-type earphone including a pressure equilibrium means according to the related art.
Figure 2:
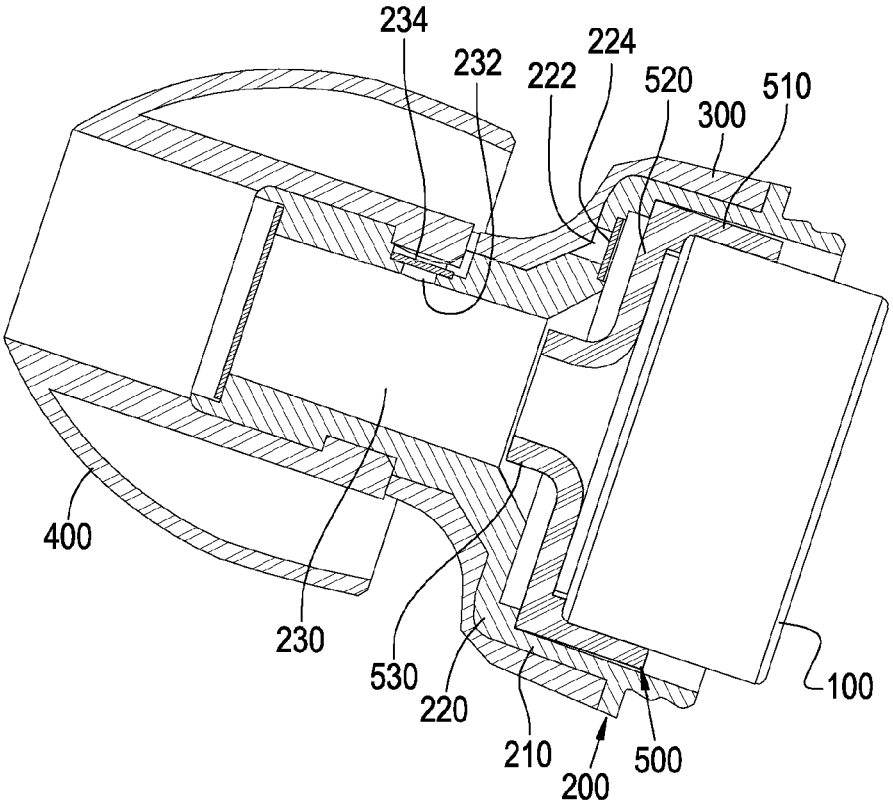
FIG. 2 is a cross-sectional view of a canal-type earphone having a pressure equilibrium structure according to a first embodiment of the present disclosure.

FIG. 2 is a cross-sectional view of a canal-type earphone having a pressure equilibrium structure according to a first embodiment of the present disclosure.

A canal-type earphone having a pressure equilibrium structure according to the first embodiment of the present disclosure includes a microspeaker 100, an accommodation space accommodating the microspeaker 100, an earphone housing 200 having a nozzle 230 extending to one side of the accommodation space, and an eartip 400 coupled to an outlet side of the nozzle to hermetically close an ear.

Here, a structure for pressure equilibrium include vent holes 222 and 232 formed at the earphone housing 200, and a switch bracket 300 for adjusting an opening degree of the vent holes 222 and 232 and opening and closing the vent holes 222 and 232 is rotatably coupled to an outer surface of the earphone housing 200.

In addition, the canal-type earphone having a pressure equilibrium structure according to the first embodiment of the present disclosure may further include a sound guide bracket 500 for guiding sound emitted from the microspeaker 100 toward the outlet of the nozzle 230, rather than toward the vent holes 222 and 232.

Hereinafter, the front or front side refers to a side where a diaphragm is located with respect to the microspeaker 100 in a sound emission direction of the microspeaker 100 or refers to a direction in which the nozzle 230 and the eartip 400 are located based on the entirety of the earphone. Therefore, the rear or rear side refers to a yoke side of the microspeaker 100 or refers to an opposite direction of the nozzle 230 and the eartip 400 based on the entirety of the earphone.

First, the microspeaker 100, like a general microspeaker, includes a frame (not shown), a yoke coupled to the frame, a permanent magnet, a magnetic circuit having a top plate, a voice coil vibrating by a mutual electromagnetic force with the magnetic circuit, and a diaphragm (not shown) attached to the rear side of the voice coil and vibrating together with vibration of the voice coil to generate the sound. The microspeaker 100 may selectively includes a cover coupled to the frame to cover a front side of the diaphragm, and in the first embodiment of the present disclosure illustrated in FIG. 2, the microspeaker 100 includes a cover.

The earphone housing 200 surrounding the outside of the microspeaker 100 includes a side surface 210 surrounding an outer circumference of the frame of the microspeaker 100, a front surface 220 located in front of the diaphragm, and a nozzle 230 protruding forward from the center of the front surface 220.

In order to prevent an increase in pressure inside the ear canal due to vibration of the diaphragm of the microspeaker 100 as the ear canal is completely sealed by the eartip 400, the earphone housing 200 includes vent holes 222 and 232 allowing internal and external air to communicate with each other. The vent holes 222 and 232 are located in front of the microspeaker 100 in the earphone housing 200. For example, the vent hole 222 may be formed in the front surface 220 of the earphone housing 200 or the vent hole 232 may be formed at the nozzle 230 of the earphone housing 200. One or more vent holes 222 and 232 are provided in front of the microspeaker 100, and in a second embodiment of the present disclosure, the vent holes 222 and 232 are provided on both the front surface 220 and the nozzle 230 of the earphone housing 200.

The vent holes 222 and 232 may be provided with meshes 224 and 234 capable of controlling the amount of ventilation and preventing penetration of moisture or foreign substances. The meshes 224 and 234 may be of a water-repellent type or a non-water-repellent type.

In addition, the switch bracket 300 may be coupled to an outer surface of the earphone housing 200. The switch bracket 300 may be rotatably coupled to the earphone housing 200 in a threaded manner. The degree of opening or opening and closing of the vent holes 222 and 232 is determined according to a relative position of the switch bracket 300 with respect to the earphone housing 200. The switch bracket 300 may completely seal the vent holes 222 and 232 to completely block external noise and sound leakage and open both the vent holes 222 and 232 to relieve a deafening feeling of the ear canal.

Figure 3:
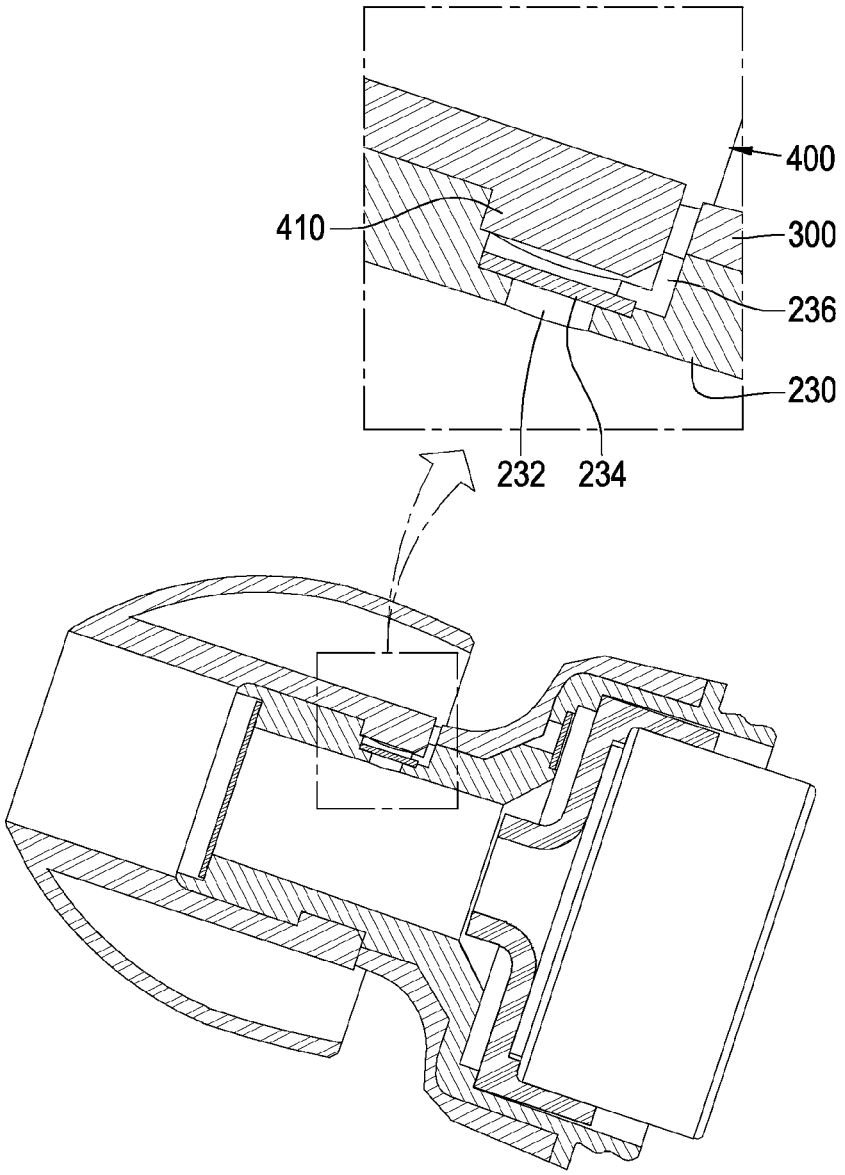
FIG. 3 is an enlarged view showing an opening and closing structure of a switch bracket 300 of the canal-type earphone having a pressure equilibrium structure according to the first embodiment of the present disclosure.

FIG. 3 is an enlarged view showing an opening and closing structure of the switch bracket 300 of the canal-type earphone having a pressure equilibrium structure according to the first embodiment of the present disclosure.

Referring to FIG. 3, an interval exists between the vent hole 232 formed at the nozzle 230 of the earphone housing 200 and an inner surface 410 of the eartip 400. The eartip 400 covers the vent hole 232 at an interval when viewed from the outside. This interval is used as a vent path through which outside air may enter and exit through the vent hole 232. When the mesh 234 is provided in the vent hole 232, a space between a recess 236 provided on the outside of the mesh 234 and the eartip 400 is used as a vent path. A width of the recess 236 is preferably larger than a diameter of the vent hole 232. The switch bracket 300 rotates and rises to close a gap between the inner surface 410 of the eartip 400 and the recess 236 to prevent air from flowing into and out of the vent hole 232.

Meanwhile, the switch bracket 300 may be coupled only with the nozzle 230 of the earphone housing 200 to open and close only the vent hole 232 formed at the nozzle 230 or may also be coupled with the front surface 220 of the earphone housing 200 to open and close the vent hole 222 formed on the front surface 220.

When the switch bracket 300 is coupled to the earphone housing 200, there should be no sound leak, and when sound leak occurs, sealing is required to prevent sound leak. Sealing may be formed of a rubber ring, poron, or the like.

Referring back to FIG. 2, the sound guide bracket 500 for guiding sound emitted from the microspeaker 100 to the nozzle 230 may be interposed between the microspeaker 100 and the earphone housing 200. The sound guide bracket 500 is coupled to the front of the microspeaker 100. The sound guide bracket 500 includes a side surface 510 located between an outer surface of the microspeaker 100 and an inner surface of the earphone housing 200, a front surface 520 covering a front surface of the microspeaker 100, and a guide tube 530 installed at the center of the front surface 520 and protruding and extending into the nozzle 230.

The guide tube 530 may guide sound emitted forward from the microspeaker 100 to the nozzle 230. Therefore, it is possible to prevent sound from being emitted through the vent hole 222 located on the front surface 220 of the earphone housing 200, thereby preventing sound leakage and loss. Therefore, preferably, the guide tube 530 does not overlap the vent hole 222 located on the front surface 220 of the earphone housing 200 in radius.

Figure 4:
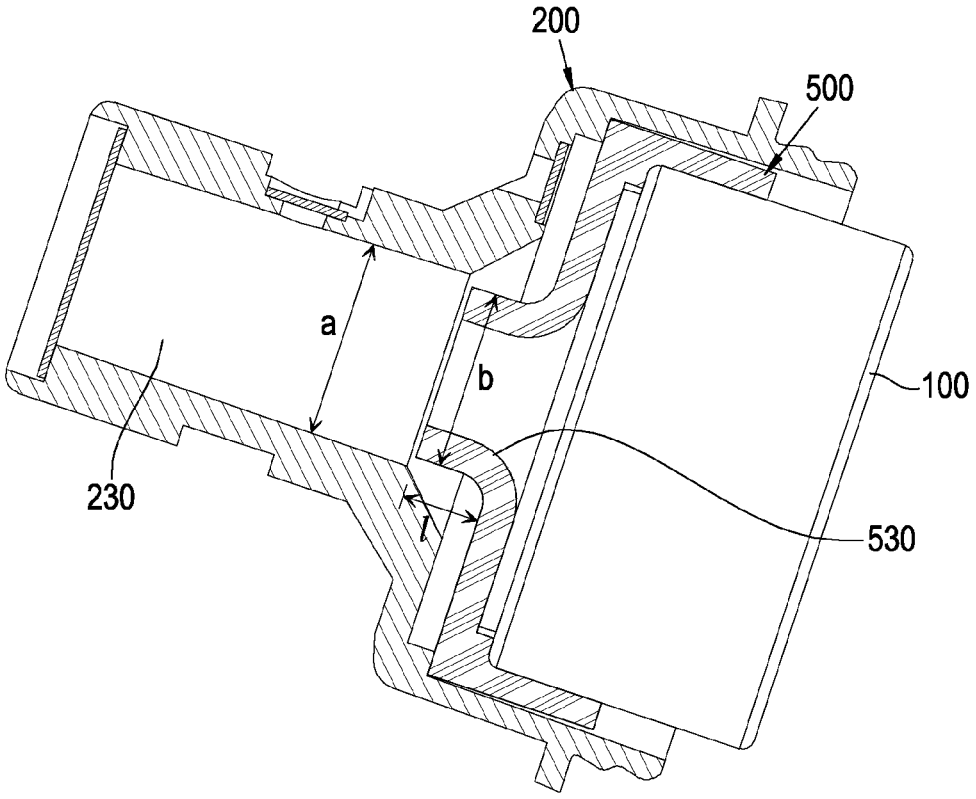
FIG. 4 is a view showing a coupling state of a microspeaker and an earphone housing of a canal-type earphone having a pressure equilibrium structure according to the first embodiment of the present disclosure.

FIG. 4 is a view showing a coupling state of a microspeaker and an earphone housing of a canal-type earphone having a pressure equilibrium structure according to a first embodiment of the present disclosure. A diameter b of the guide tube 530 of the sound guide bracket 500 according to the first embodiment of the present disclosure may be selected within a diameter range of the nozzle 230. In addition, a length l of the guide tube 530 may be freely selected within a length of the front surface of the microspeaker 100 and an outlet of the nozzle 230.

Compared with the related art, the related art employs a structure in which the front and rear of the microspeaker 100 allows air to flow to make pressure equilibrium, and thus, a gasket needs to be installed between the microspeaker and the earphone housing and a vent hole is formed at the gasket. In contrast, in the canal-type earphone having the pressure equilibrium structure according to the present disclosure, there is no need to install a gasket as the vent holes 222 and 232 are located in front of the earphone housing 200, that is, in front of the microspeaker 100. In addition, since the vent holes 222 and 232 for achieving pressure equilibrium are located in front of the earphone housing 200, the microspeaker 100 acts as a kind of soundproofing wall and is advantageous in blocking external noise, while ventilating.

In addition, since the vent holes 222 and 232 are formed in the earphone housing 200 itself, it is advantageous compared to the related art in terms of dustproof, waterproof, appearance, and a product size. By simply installing a water-repellent mesh in the vent holes 222 and 232, it is possible to obtain a waterproof effect, thereby reducing cost. In addition, by removing a gasket installed between the speaker unit and the housing and installing the sound guide bracket 500, a space for air to flow in and out through the vent holes 222 and 232 may be secured and leakage of sound through the vent holes 222 and 232 may be prevented.

Figure 5:
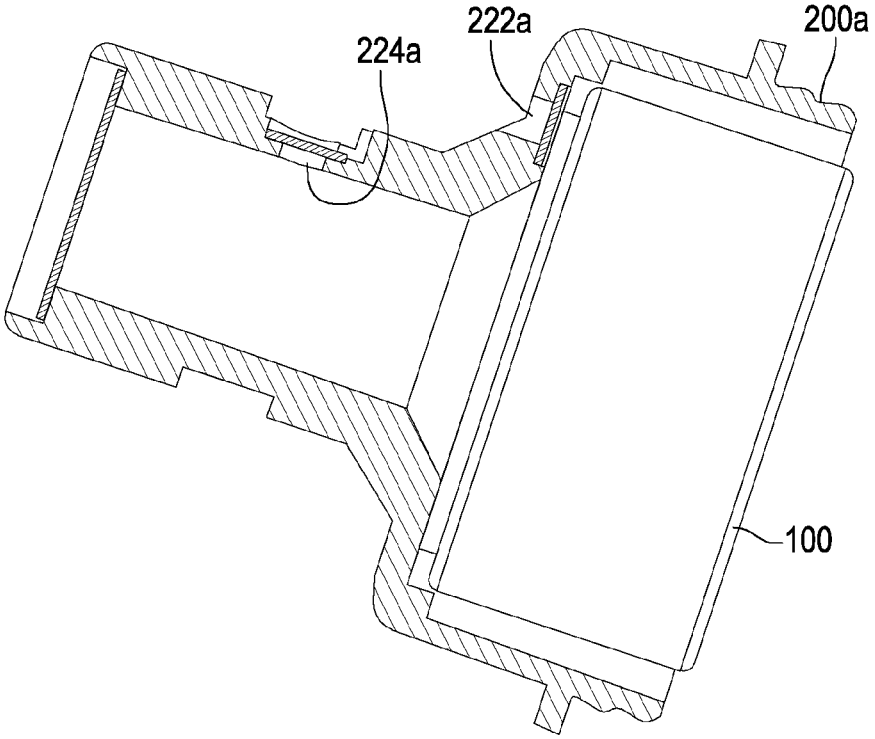
FIG. 5 is a view showing a coupling state of a microspeaker and an earphone housing of a canal-type earphone having a pressure equilibrium structure according to a second embodiment of the present disclosure.

FIG. 5 is a view showing a coupling state of a microspeaker and an earphone housing of a canal-type earphone having a pressure equilibrium structure according to a second embodiment of the present disclosure. The second embodiment of the present disclosure is the same as the first embodiment, except that no sound guide bracket is installed between the microspeaker 100 and an earphone housing 200*a*. Although not shown in FIG. 5, the switch bracket and the eartip may be coupled to the earphone housing 200*a* also in the second embodiment.

The canal-type earphone according to the second embodiment of the present disclosure has the advantage that the earphone may become more compact overall by omitting the sound guide bracket.

Figure 6:
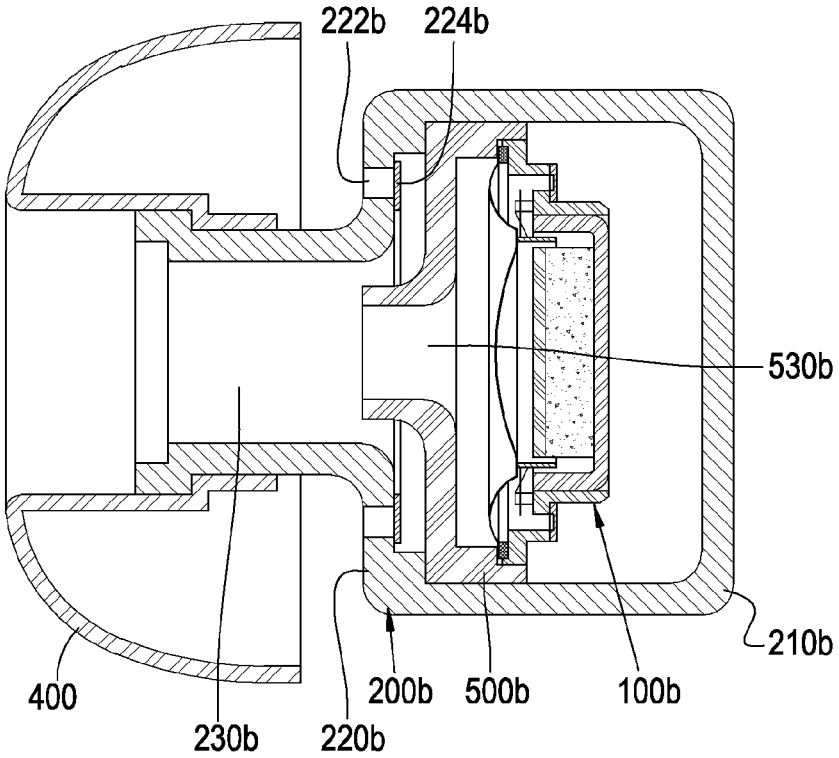
FIG. 6 is a cross-sectional view of a canal earphone having a pressure equilibrium structure according to a third embodiment of the present disclosure.

FIG. 6 is a cross-sectional view of a canal-type earphone having a pressure equilibrium structure according to a third embodiment of the present disclosure.

A canal-type earphone having a pressure equilibrium structure according to the third embodiment of the present disclosure includes a microspeaker 100*b*, an accommodation space 210*b* accommodating the microspeaker 100*b*, an earphone housing 200*b* including a nozzle 230*b* extending to one side of the accommodation space, and an eartip 400 coupled to an outlet side of the nozzle to seal the ear.

In the third embodiment of the present disclosure, a diaphragm is exposed without a separate cover in the microspeaker 100*b*. The third embodiment of the present disclosure includes a vent hole 222*b* formed at the earphone housing 200*b* as a structure for pressure equilibrium. Unlike the first embodiment, the vent hole 222*b* is not provided at the nozzle 230*b* and a plurality of vent holes are provided only on the front surface 220*b* of the earphone housing 200*b*.

In addition, a sound guide bracket 500*b* for guiding sound emitted from the microspeaker 100 to the outlet side of the nozzle 230, without directing to the vent hole 222*b*, may be further included.

First, the microspeaker 100, like a general microspeaker, includes a frame (not shown), a yoke coupled to the frame, a permanent magnet, a magnetic circuit having a top plate, a voice coil vibrating by a mutual electromagnetic force with the magnetic circuit, and a diaphragm (not shown) attached to the rear side of the voice coil and vibrating together with vibration of the voice coil to generate the sound. The microspeaker 100 may selectively includes a cover coupled to the frame to cover a front side of the diaphragm, and in the third embodiment of the present disclosure illustrated in FIG. 6, the microspeaker 100*b* does not include a cover.

The earphone housing 200*b* surrounding the outside of the microspeaker 100*b* includes a side surface 210*b* surrounding an outer circumference of the frame of the microspeaker 100*b*, a front surface 220*b* located in front of the diaphragm, and a nozzle 230*b* protruding forward from the center of the front surface 220.

In order to prevent an increase in pressure inside the ear canal due to vibration of the diaphragm of the microspeaker 100*b* as the ear canal is completely sealed by the eartip 400, the earphone housing 200*b* includes vent holes 222*b* allowing internal and external air to communicate with each other. The vent hole 222*b* is located in front of the microspeaker 100*b* in the earphone housing 200*b*. In the third embodiment of the present disclosure, the vent hole 222*b* is formed only in the front surface 220*b* of the earphone housing 200*b*. One or more vent holes 222*b* are provided in front of the microspeaker 100*b*, and in the third embodiment of the present disclosure, the plurality of vent holes 222*b* are provided on the front surface 220*b* of the earphone housing 200*b*.

The vent hole 222*b* may be provided with a mesh 224*b* capable of controlling the amount of ventilation and preventing penetration of moisture or foreign substances. The mesh 224*b* may be of a water-repellent type or a non-water-repellent type. In the third embodiment of the present disclosure, the mesh 224*b* is attached to an inner surface of the earphone housing 200*b*.

A sound guide bracket 500*b* for guiding sound emitted from the microspeaker 100*b* to the nozzle 230*b* may be interposed between the microspeaker 100*b* and the earphone housing 200*b*. The sound guide bracket 500*b* has a shape for covering the diaphragm of the microspeaker 100*b* and includes a guide tube 530*b* provided at the center of the front and protruding and extending into the nozzle 230*b*.

The guide tube 530*b* may guide sound emitted forward from the microspeaker 100*b* to the nozzle 230*b*. Therefore, it is possible to prevent sound from being emitted through the vent hole 222*b* located on the front surface 220*b* of the earphone housing 200*b*, thereby preventing sound leakage and loss. Therefore, preferably, the guide tube 530*b* does not overlap the vent hole 222*b* located on the front surface 220*b* of the earphone housing 200*b* in radius.

Figure 7:
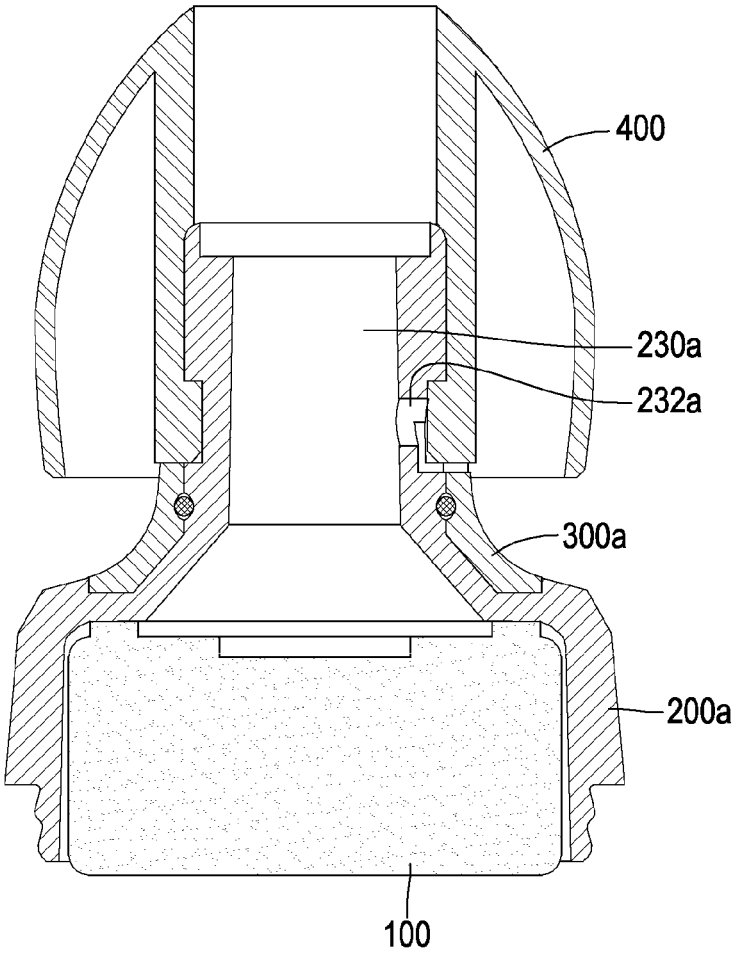
FIG. 7 is a cross-sectional view of a canal earphone having a pressure equilibrium structure according to a fourth embodiment of the present disclosure.

FIG. 7 is a cross-sectional view of a canal-type earphone having a pressure equilibrium structure according to a fourth embodiment of the present disclosure.

The canal-type earphone having a pressure equilibrium structure according to the fourth embodiment of the present disclosure includes a microspeaker 100*c*, an accommodation space accommodating the microspeaker 100*c*, an earphone housing 200*c* including a nozzle 230*c* extending to one side of the accommodation space, and an eartip 400 coupled to an outlet side of the nozzle to seal the ear.

In the fourth embodiment of the present disclosure, unlike the first embodiment, a vent hole 232*c*, as a pressure equilibrium structure, is provided only at the nozzle 230*c*. Therefore, since no vent hole is provided at the front surface of the accommodation space of the earphone housing 200*c*, a possibility of leakage of sound is reduced and a sound guide bracket may be omitted.

Meanwhile, a switch bracket 300*c* for opening and closing the vent hole 232*c* formed at the nozzle 230*c* may be coupled to an outer surface of the earphone housing 200*c*. An interval exists between the vent hole 232*c* formed at the nozzle 230*c* of the earphone housing 200*c* and an inner surface of the eartip 400. The eartip 400 covers the vent holes 232*c* at an interval when viewed from the outside. This interval is used as a vent path through which external air may flow in and out through the vent hole 232*c*. The interval may be secured wider by a recess 236*c* formed with a width larger than a diameter of the vent hole 232*c* so that the nozzle includes the vent hole 232*c* therein. A space between the recess 236*c* and the eartip 400 may be used as a vent path. The switch bracket 300*c* rotates and rises to close a gap between an inner surface of the eartip 400 and the recess 236*c* of the outer surface of the nozzle 230*c* to prevent air from flowing in and out through the vent hole 232.

Figure 8:
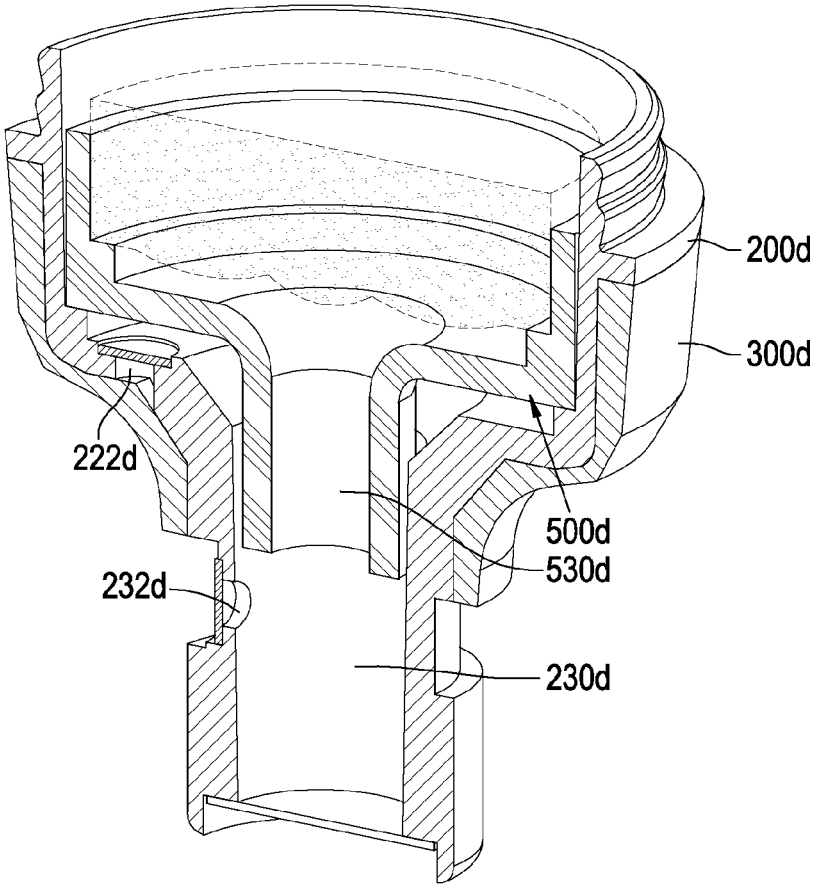
FIG. 8 is a cross-sectional perspective view of a canal-type earphone having a pressure equilibrium structure according to a fifth embodiment of the present disclosure.

FIG. 8 is a cross-sectional perspective view of a canal-type earphone having a pressure equilibrium structure according to a fifth embodiment of the present disclosure.

The canal-type earphone having a pressure equilibrium structure according to the fifth embodiment of the present disclosure is the same as the first embodiment, except that a cover is not provided on a microspeaker 100*d* and a guide tube 530*d* of a sound guide bracket 500*d* is longer.

Similar to the first embodiment, an earphone housing 200*d* includes a side surface 210*d* surrounding an outer circumference of a frame of the microspeaker 100*d*, a front surface 220*d* located in front of a diaphragm, and a nozzle 230*d* protruding forward from the center of the front surface 220*d*.

In addition, the sound guide bracket 500*d* also includes a side surface 510*d*, a front surface 520*d*, and the guide tube 530*d*.

Referring to FIG. 8, the front surface 220*d* of the earphone housing 200*d* and the front surface 520*d* of the sound guide bracket 500*d* are disposed to be spaced apart from each other, and the nozzle 230 of the earphone housing 200*d* and the guide tube 530*d* of the sound guide bracket 500*d* are disposed to be spaced apart from each other. Accordingly, air flowing in and out through the vent hole 222*d* formed in the front surface 220*d* of the earphone housing 200*d* moves through a space between the sound guide bracket 500*d* and the earphone housing 200*d*.

The flow of air from the vent hole 222*d* to the nozzle 230*d* using the sound guide bracket 500*d* may also be applied to a case in which the microspeaker includes a cover in front of a diaphragm, as well as to a structure in which the microspeaker 100*d* does not include a separate cover as in the fifth embodiment shown in FIG. 8.

Figure 9:
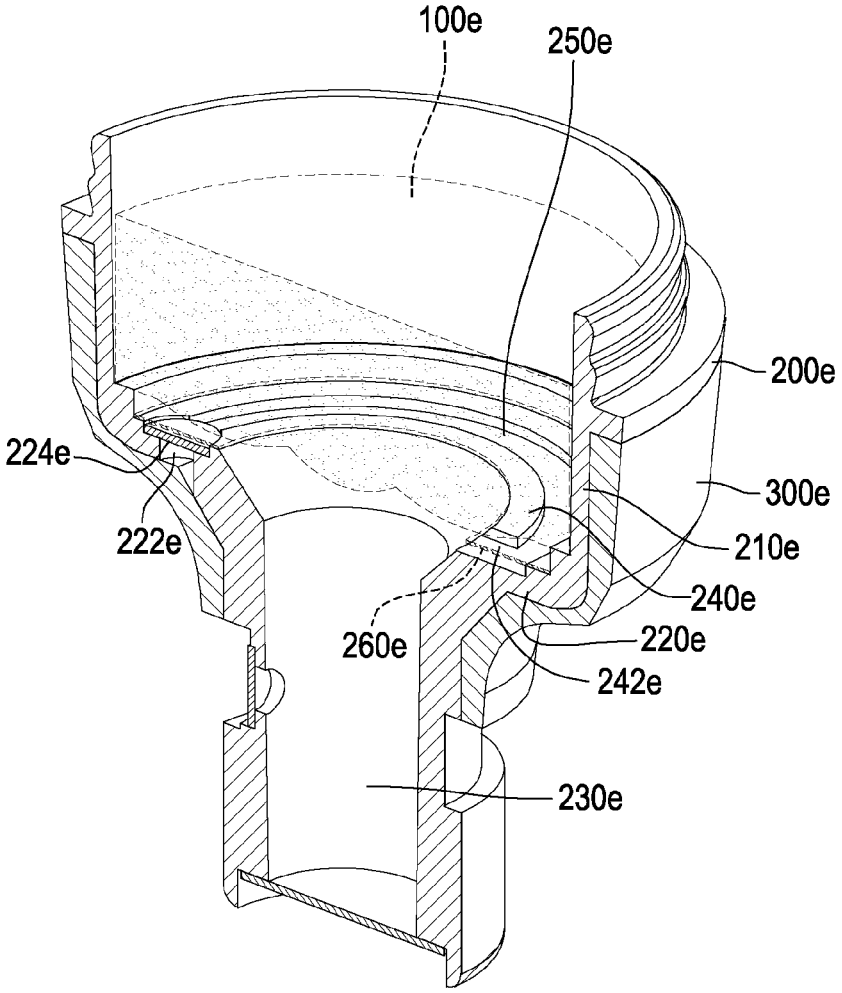
FIG. 9 is a cross-sectional perspective view of a canal-type earphone having a pressure equilibrium structure according to a sixth embodiment of the present disclosure.

FIG. 9 is a cross-sectional perspective view of a canal-type earphone having a pressure equilibrium structure according to a sixth embodiment of the present disclosure.

The canal-type earphone having a pressure equilibrium structure according to the sixth embodiment of the present disclosure is the same as the first embodiment, except that a cover is not provided on the microspeaker 100*e* and a sound guide bracket 500*e* is not separately provided.

Similar to the first embodiment, an earphone housing 200*e* includes a side surface 210*e* surrounding an outer circumference of a frame of the microspeaker 100*e*, a front surface 220*e* located in front of a diaphragm, and a nozzle 230*e* protruding forward from the center of the front surface 220*e*. However, unlike the first embodiment, the earphone housing 200*e* has an arc-shaped recess 250*e* connected to a vent hole 222*e* on an inner surface thereof. A rib 240*e* may be provided at an inner circumference of the recess 250*e*, i.e., at a position in contact with the nozzle 230*e* and protrude backward compared with the recess 250*e*. The rib 240*e* preferably has the same height as a height of an outer circumference of the recess 250*e*.

In this case, an adherend 260*e*, such as a film or tape, may be attached to the inner surface of the earphone housing 200*e* to cover the recess 250*e* and form a conduit. Accordingly, external air flowing in and out through the vent hole 222*e* does not directly flow into the nozzle 230*e* but flows along the conduit defined by the recess 250*e* and the adherend 260*e*. Here, a partial section of the rib 240*e* is deleted to form a communication hole 242*e* connecting the conduit and the nozzle 230*e* each other.

The conduit serves to compensate for loss of sound pressure at a low frequency range as the canal-type earphone is not completely sealed.

Figure 10:
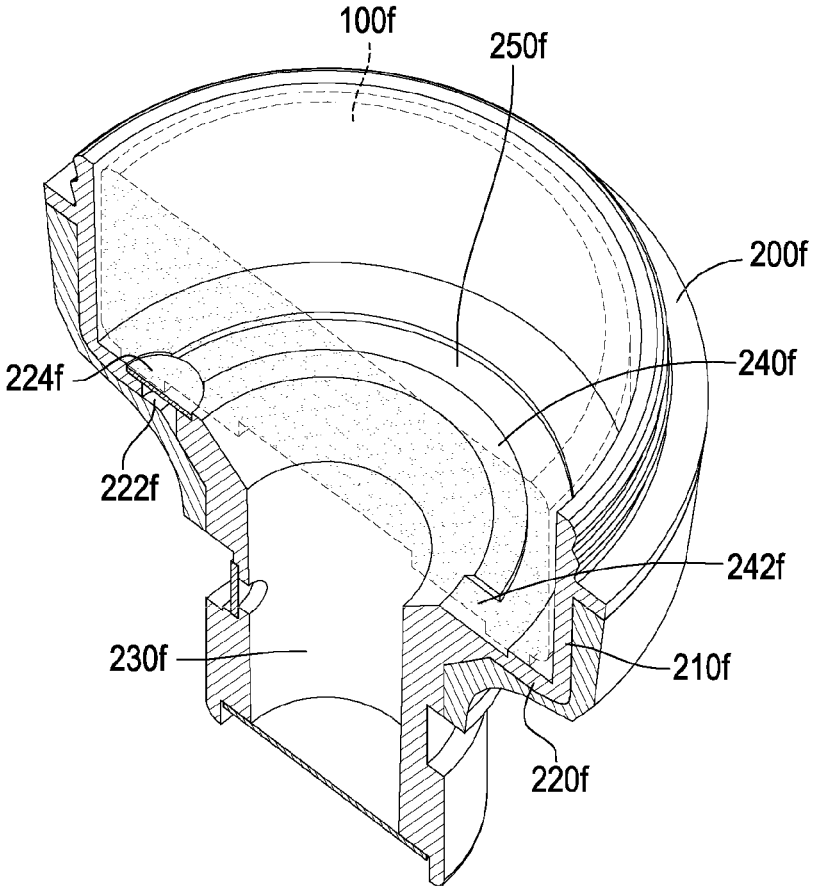
FIG. 10 is a cross-sectional perspective view of a canal-type earphone having a pressure equilibrium structure according to a seventh embodiment of the present disclosure.

FIG. 10 is a cross-sectional perspective view of a canal-type earphone having a pressure equilibrium structure according to a seventh embodiment of the present disclosure.

The canal-type earphone having a pressure equilibrium structure according to the seventh embodiment of the present disclosure is the same as that of the sixth embodiment, except that a microspeaker 100*f* has a cover.

Similar to the first and sixth embodiments, an earphone housing 200*f* includes a side surface 210*f* surrounding an outer circumference of a frame of the microspeaker 100*f*, a front surface 220*f* located in front of a diaphragm, and a nozzle 230*f* protruding forward from the center of the front surface 220*f*. However, unlike the first embodiment, the earphone housing 200*f* has an arc-shaped recess 250*f* connected to a vent hole 222*f* on an inner surface thereof. A rib 240*f* may be provided at an inner circumference of the recess 250*f*, i.e., at a position in contact with the nozzle 230*f* and protrude backward compared with the recess 250*f*. The rib 240*f* preferably has the same height as a height of an outer circumference of the recess 250*f*.

In this case, unlike the first embodiment, the inner surface of the earphone housing 200*f* is not spaced apart from the front surface of the microspeaker 100*f* but in contact with each other. Accordingly, the cover of the microspeaker 100*f* covers the recess 250*f* to form a conduit. Accordingly, external air flowing in and out through the vent hole 222*f* does not directly flow into the nozzle 230*f* but flows along the conduit defined by the recess 250*f* and the conduit defined by the cover of the microspeaker 100*f*. Here, a partial section of the rib 240*f* is deleted to form a communication hole 242*f* connecting the conduit and the nozzle 230*f* each other.

The conduit serves to compensate for loss of sound pressure at a low frequency range as the canal-type earphone is not completely sealed.

Figure 11:
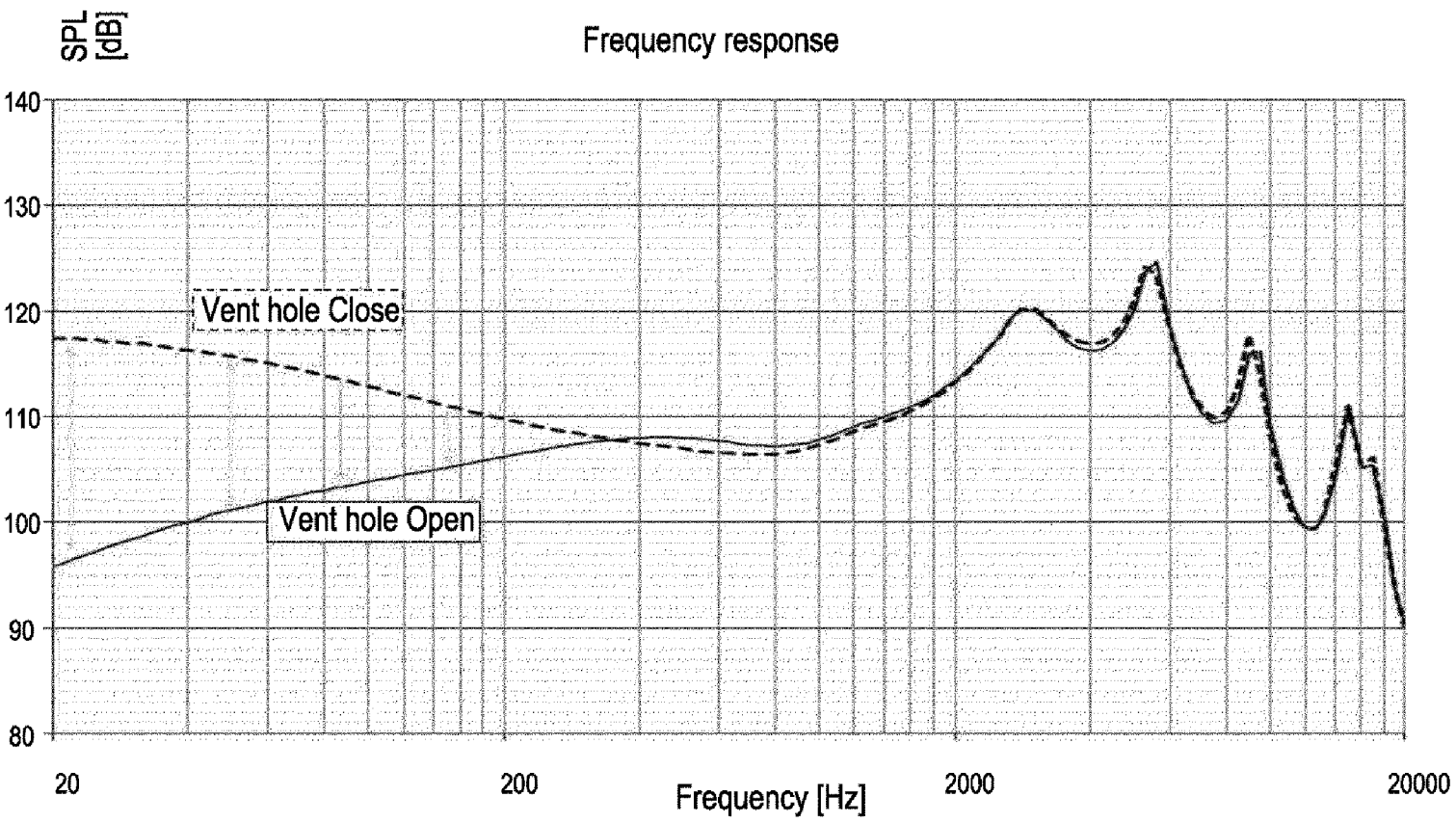
FIG. 11 is a graph comparing sound pressure when a vent hole of a canal-type earphone having a pressure equilibrium structure according to the first embodiment of the present disclosure is opened and closed.

FIG. 11 is a graph comparing sound pressure when a vent hole of a canal-type earphone having a pressure equilibrium structure according to the first embodiment of the present disclosure is opened and closed.

As can be seen from the graph, generally, when the vent hole is closed, a sound pressure level (SPL) is high at a low frequency region, and when the vent hole is opened to relieve deafening of the ear, loss of SPL occurs at the low frequency region. Therefore, the user may adjust a use aspect of the earphone by selectively opening the vent hole using the switch bracket to resolve deafening of the ear or improving a sound pressure of the low frequency range.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A canal-type earphone having a pressure equilibrium structure, comprising:

a microspeaker including a frame, a magnetic circuit, a voice coil, and a diaphragm;

an earphone housing including an accommodation space accommodating the microspeaker and a nozzle extending to one side of the accommodation space;

a vent hole formed at the earphone housing, installed in at least one of portions located in front of the microspeaker on the nozzle, and allowing air to flow outside and inside the earphone housing;

an eartip coupled to outside of the nozzle of the earphone housing, wherein the nozzle includes a recess provided on an outer surface of the nozzle, communicating with the vent hole on the earphone housing, and having a gap with an inner surface of the eartip;

a switch bracket rotatably coupled to the earphone housing, adjusting an opening degree of the vent hole, and closing the vent hole; and a vent path defined by the inner surface of the eartip and the recess of the nozzle and communicating with the vent hole on the earphone housing, wherein the switch bracket opens and closes the vent path.

2. The canal-type earphone of claim 1, further comprising:

a mesh covering the vent hole.

3. The canal-type earphone of claim 1, further comprising:

a sealing member provided between the switch bracket and the earphone housing.

4. The canal-type earphone of claim 1, wherein:

the vent hole includes at least one vent hole formed in the one portion located in front of the microspeaker in the accommodation space; and the earphone housing has a conduit provided on an inner surface thereof and communicating with the vent hole.

5. The canal-type earphone of claim 4, wherein the conduit is formed by a rib protruding from the inner surface of the earphone housing.

6. The canal-type earphone of claim 1, further comprising:

a sound guide bracket coupled to a front surface of the microspeaker and having a guide tube extending into the nozzle.

7. The canal-type earphone of claim 6, wherein:

the vent hole includes at least one vent hole formed at a portion located in front of the microspeaker in the accommodation space; and a surface on which the vent hole is formed in the accommodation space and the bracket are spaced apart from each other.

8. The canal-type earphone of claim 7, further comprising:

a conduit communicating the vent hole with the nozzle, wherein the conduit is formed by a rib protruding from the inner surface of the earphone housing to the bracket.

9. A canal-type earphone having a pressure equilibrium structure, comprising:

a microspeaker including a frame, a magnetic circuit, a voice coil, and a diaphragm;

an earphone housing including an accommodation space accommodating the microspeaker and a nozzle extending to one side of the accommodation space;

at least one vent hole formed at the earphone housing, installed in at least one of portions located in front of the microspeaker, in the accommodation space, and allowing air to flow outside and inside the earphone housing; and an eartip coupled to outside of the nozzle of the earphone housing, wherein the earphone housing has a conduit provided on an inner surface of the earphone housing and communicating with the at least one vent hole, wherein the conduit is formed by a rib protruding from the inner surface of the earphone housing and a counterpart attached to the rib.

10. The canal-type earphone of claim 9, wherein the counterpart is any one of a cover, a tape, a film, and a sheet covering the diaphragm of the microspeaker.

11. The canal-type earphone of claim 9, further comprising:

a mesh covering the at least one vent hole.

12. The canal-type earphone of claim 9, further comprising:

a switch bracket rotatably coupled to the earphone housing, adjusting an opening degree of the at least one vent hole, and closing the at least one vent hole.

13. The canal-type earphone of claim 12, wherein the at least one vent hole is further provided on the nozzle, wherein the nozzle includes a recess provided on an outer surface thereof, communicating with the at least one vent hole on the earphone housing, and having a gap with an inner surface of the eartip, the canal-type earphone further comprising:

a vent path defined by the inner surface of the eartip and the recess of the nozzle and communicating with the at least one vent hole, wherein the switch bracket opens and closes the vent path.

14. The canal-type earphone of claim 12, further comprising:

a sealing member provided between the switch bracket and the earphone housing.

15. The canal-type earphone of claim 9, further comprising:

a sound guide bracket coupled to a front surface of the microspeaker and having a guide tube extending into the nozzle.

* * * * *